US006425965B1

(12) United States Patent
Silva

(10) Patent No.: US 6,425,965 B1
(45) Date of Patent: Jul. 30, 2002

(54) ULTRA LOW DENSITY EXPLOSIVE COMPOSITION

(76) Inventor: Guillermo Silva, 13 Riverside Drive, Kingston, Ontario (CA), K7L 4V1

( * ) Notice: Subject to any disclaimer, the term of this patent is extended or adjusted under 35 U.S.C. 154(b) by 0 days.

(21) Appl. No.: 09/377,843

(22) Filed: Aug. 20, 1999

(51) Int. Cl.[7] ..... C06B 45/00; C06B 45/10; D03D 23/00

(52) U.S. Cl. ..... 149/2; 149/19.4; 149/109.6

(58) Field of Search ..... 149/19.9, 46, 109.6, 149/19.4, 19.6, 2, 21, 5

(56) References Cited

U.S. PATENT DOCUMENTS 4,708,753 A * 11/1987 Forsberg ..... 149/2
4,732,626 A * 3/1988 Edamura et al. ..... 149/21
4,736,683 A * 4/1988 Bachman et al. ..... 102/290
4,818,309 A * 4/1989 Yabsley et al. ..... 149/2
4,822,433 A * 4/1989 Cooper et al. ..... 149/2
4,844,756 A * 7/1989 Forsberg ..... 149/2
4,908,080 A * 3/1990 Amano et al. ..... 149/2
4,919,178 A * 4/1990 Riga et al. ..... 149/2
5,034,071 A * 7/1991 VanOmmeren ..... 149/7
5,074,939 A * 12/1991 Sanders et al. ..... 149/21
5,401,341 A * 3/1995 Forsberg et al. ..... 149/46
5,460,670 A * 10/1995 Cechanski ..... 149/109.6
5,639,988 A * 6/1997 Cechanski ..... 149/46

* cited by examiner

*Primary Examiner*—Michael J. Carone
*Assistant Examiner*—Aileen J. Baker
(74) *Attorney, Agent, or Firm*—Ridout & Maybee

(57) ABSTRACT

An explosive composition is provided which comprises a mixture of a particulate low density agent and a particulate oxidising agent. The particulate low density agent is a synthetic polymeric low density agent, e.g. foamed polystyrene, which is coated with a 5 to 30 wt % of a first wetting agent. The first wetting agent comprises a first flowable carbonaceous fuel, e.g. mineral oil, and a first tackifying agent for the first flowable carbonaceous fuel. The particulate oxidizing agent is coated with a second wetting agent. The second wetting agent comprises a second flowable carbonaceous fuel, e.g. mineral oil, and a second tackifying agent for the second flowable carbonaceous fuel. The first and second wetting agents may be the same. The explosive compositions may have densities of less than about 0.2 g/cm$^3$.

21 Claims, No Drawings

ULTRA LOW DENSITY EXPLOSIVE COMPOSITION

FIELD OF INVENTION

The present invention relates to an ultra low density particulate composition, particularly one which can be used alone, or mixed with other explosive compositions to modify their properties.

BACKGROUND TO THE INVENTION

Ammonium nitrate and fuel oil explosive compositions (ANFO) have been used extensively for commercial blasting since the 1950's. In addition to being used alone, ANFO has also been incorporated into slurry and emulsion explosives as means of modifying the performance and/or the density of such explosives.

Explosives are usually purchased on a weight basis and therefore the density of the explosive compositions is sometimes a factor in determining the selection of an explosive for a particular job. Common low density inert agents are expanded perlite and glass bubbles. Other ingredients have also been used. Gotz et al. in E. German patent 246 457 which was published Jun. 10, 1987 discloses an explosive with 10–80 vol. % ammonium nitrate treated with 0–1 vol. % diesel fuel and 90-20 vol. % foamed polystyrene. U.S. Pat. No. 5,505,800 to Gribble et al. which issued Apr. 9, 1996 discloses an ANFO explosive with some or all of the fuel oil replaced with a solid fuel, e.g. gilsonite, coal, rubber, polystyrene. U.S. Pat. No. 4,957,569 to Waldock et al., which issued Sep. 18, 1990 discloses an emulsion explosive with oxidizer salts held in a disperse phase in oil, to which bulking agents such as sawdust, foamed polystyrene beads, perlite or vermiculite have been added. Russian patent 1601972 published Jul. 9, 1995 discloses explosive compositions containing granular ammonium nitrate and polystyrene, with the latter being expanded in a hot aqueous solution of ethylene glycol as an inherent stage of the composition's manufacturing process.

The present invention is directed to other means for lowering the density of particulate explosives.

The terms "comprising" and "comprises" when used in this specification are taken to specify the presence of the stated features, integers, steps or components but do not preclude the presence or addition of one or more other features, integers, steps, components or groups thereof.

SUMMARY OF INVENTION

Accordingly, the present invention provides an explosive composition comprising a mixture of:

a) a particulate synthetic polymeric low density agent coated with from 5 to 30 wt. %, based on the low density agent weight, of a first wetting agent which comprises a first flowable carbonaceous fuel and a first tackifying agent for said first flowable carbonaceous fuel; and b) a particulate oxidizing agent, coated with a second wetting agent which comprises a second flowable carbonaceous fuel and a second tackifying agent for said second flowable carbonaceous fuel.

The term "flowable carbonaceous fuel", in the present context, refers to carbonaceous fuels which can flow under gravity without excessive heating, e.g. flows at temperatures less than about 110° C. The term encompasses those fuels which flow at room temperature or below, e.g. mineral oil, lubricants, as well as those, e.g. molasses, greases, light waxes and sugars which require moderate heating.

The terms "tackifying agent" and "tackifier" as used herein are synonymous and refer to agents for tackifying oils. Such terms are understood in the petroleum and synthetic lubricant arts. Tackifiers may be used, for example, in motor oil, mineral oil and the like.

In one embodiment, the second wetting agent is the same as the first wetting agent.

In one embodiment, the particulate low density agent is selected from the group consisting of synthetic thermoplastic polymer bubbles and expanded synthetic carbonaceous polymers.

In a further embodiment, the expanded synthetic carbonaceous polymer is selected from the group consisting of a foamed polystyrene, a foamed polyurethane, a foamed polyolefin and mixtures thereof.

In another embodiment, the expanded synthetic carbonaceous polymer has a density of less than about 0.1 g/cm$^3$.

In one embodiment, the polyolefin is polyethylene.

In yet another embodiment, the preferred particulate low density agent is a foamed polystyrene having a density of less than about 0.05 g/cm$^3$.

In another embodiment, the flowable carbonaceous fuel is selected from paraffinic oils, vegetable oils, greases, light waxes, saccharose, glucose, fructose, maltose, molasses and mixtures thereof. Preferred flowable carbonaceous fuels are paraffinic oils, vegetable oils, sugar based fuels and light waxes. Examples of paraffinic oils include mineral oils, lubricating oils, fuel oils and diesel oils. Preferred paraffinic oils are mineral oils and lubricating oils. Most preferred is mineral oil.

In a further embodiment, the first and second tackifying agents are high molecular weight hydrocarbons In yet another embodiment, the first and second tackifying agents are ethylene-propylene copolymers.

In another embodiment, the particulate oxidizing agent is selected from alkali metal nitrates, alkaline earth metal nitrates, alkali metal chlorates, alkaline earth metal chlorates, alkali metal perchlorates, alkaline earth metal perchlorates, urea nitrates, guanidine nitrates and mixtures thereof. Preferred oxidizing agents are ammonium nitrate, calcium nitrate and sodium nitrate.

In a further embodiment, the particulate oxidizing agent passes through a 14 U.S. Standard mesh.

In yet another embodiment, the explosive composition also contains a particulate explosive compound selected from aromatic organic explosives, aliphatic organic explosives and mixtures thereof.

In yet another embodiment, the particulate explosive compound is selected from pentaerithrytol tetranitrate (PETN), cyclotrimethylenetrinitramine (RDX) and trinitrotoluene (TNT), tetramethylenetetranitramine (HMX), nitroguanidine and mixtures thereof.

In a further embodiment, the explosive composition is mixed with an explosive composition selected from the group consisting of ammonium nitrate and fuel oil mixtures (ANFO), emulsion explosive compositions, slurry explosive compositions, mixtures of ANFO and emulsion explosive compositions, and mixtures of ANFO and slurry explosive compositions. Slurry explosives are sometimes referred to in the art as water gel explosives.

DETAILED DESCRIPTION OF PREFERRED EMBODIMENTS

The present explosive composition comprises a particulate low density agent and a particulate oxidizing agent, each of which have been coated with a wetting agent. The wetting agent comprises a mixture of a flowable carbonaceous fuel and a tackifying agent. The wetting agent for the particulate low density agent may be different from the wetting agent for the particulate oxidizing agent but preferably they are the same.

The low density agent may be any suitable particulate synthetic polymeric low density material. Typically, the density is less than about 0.1 g/cm3. Foamed polystyrene beads, for example, may have a density of between about 0.01 g/cm$^3$ and 0.05 g/cm$^3$. The low density agent, which is particulate, may have particle sizes up to about 5 mm or more and preferably between about 0.5 and 5 mm. The particulate low density agent is preferably selected from the group consisting of synthetic thermoplastic polymer bubbles and expanded synthetic carbonaceous polymers. Typical expanded synthetic carbonaceous polymers are foamed polystyrene, foamed polyurethane, foamed polyolefin and mixtures thereof. Expanded polystyrene is preferred. Foamed or expanded polymers such as polystyrene are commercially available. It is to be noted that the low density agents have been pre-expanded, e.g. expanded polystyrene, and expansion of the agent during manufacture of the explosive composition is not required.

The wetting agent for the particulate low density agent is a flowable carbonaceous fuel and a tackifying agent soluble in the flowable carbonaceous fuel.

The carbonaceous fuel may be a liquid, a syrup or a light wax which can be easily liquefied, and which does not damage the low density structure of the low density agent. For example No. 2 fuel oil or diesel oil may tend to dissolve polystyrene, but may be suitable if the explosive composition is detonated shortly after manufacture. Mineral oil, vegetable oil, lubricating oils and greases and light waxes are preferred. A preferred vegetable oil is soybean oil. Saccharose, glucose, fructose, maltose, glucose syrup or molasses may also be used. The most preferred flowable carbonaceous fuels are mineral oil, vegetable oil and lubricating oil.

The tackifying agent may be selected from those compounds which are known in the lubricant industry to be tackifiers. Some tackifying agents are high molecular weight hydrocarbons, e.g. ethylene-propylene copolymers. Two tackifying agents which have been found to be useful are Vanlube TK-100 (trade mark), available from R.T. Vanderbilt Company, Inc. of Norwalk, Conn., U.S.A., and HiTec 152 (trade mark), available from Ethyl Corporation of Richmond, Va., U.S.A. Typically, from about 0.5 to about 5 wt. % of the tackifying agent is added to the flowable carbonaceous fuel. The purpose of the tackifier is to make the wetting agent adhere better to the oxidising agent and low density agent, as well as enhance the wetting characteristics of the fuel. For example, an increase in adhesion of oxidising agent of about 20 percentage points was obtained when a tackifier was added to mineral oil which was used to wet expanded polystyrene beads. The increase in adhesion can be measured by weighing the coated oxidising agent retained on the coated low density agent, after screening loose coated oxidising agent. Another method, for polystyrene as the low density agent, is to weigh the oxidising agent left after the polystyrene and carbonaceous fuel has been dissolved with toluene.

The ratio of wetting agent to particulate low density agent is preferably from about 5:95 to 30:70 on a weight basis. For example, mineral oil may be mixed with expanded polystyrene in a concentration of between about 5 wt % to 30 wt. % mineral oil to expanded polystyrene.

The oxidising agent may be any of those commonly used in the explosives industry. It will be understood that, for performance and cost reasons, ammonium nitrate is preferred as a major component of the oxidizing agent. Ammonium nitrate may be the sole oxidizing agent or some may be replaced with other particulate oxidizing agents, as is known. For example, sodium nitrate may be added to provide a composition with more explosive "heave" and/or richer oxygen supply. Sodium perchlorate or chlorate may be added to provide extra detonation sensitivity. Other nitrates, chlorates and perchlorates may be used, e.g. potassium, ammonium, calcium, lithium, aluminum, magnesium, barium and zinc nitrates, chlorates and perchlorates. The particulate oxidizing agent may be pure, e.g. Stengel crystals, or may be normal commercial grade, e.g. fertilizer and/or explosive grade ammonium nitrate. Preferably, the oxidizing agent has a particle size less than about U.S. Standard mesh size 14 (1.168 mm). Oxidizing agent having a particle size of less than about U.S. standard sieve # 20 (about 840 $\mu$m or less) is preferred. Smaller particle sizes have larger surface areas, thus enhancing the adhesion to, and coverage of, the fuel-wetted low density agent.

Although ammonium nitrate fines, i.e. those passing through a 14 mesh sieve, can be produced by crushing of larger particles, e.g. prills, prilling plants generate fines as a heretofore undesired but unavoidable by-product. The fines are already treated with anti-caking agents, which help to keep the final explosive composition free-flowing. Preferred anti-caking agents are carbonaceous surfactants. Being carbonaceous, they add to the explosive reaction of fuel and oxidising agent. Examples of such anti-caking agents are Lilamin AC-81 L (trade mark), manufactured by Berol Nobel, and Galoryl 626-M (trade mark), manufactured by Lobeco Products Inc.

The oxidising agent is coated with a wetting agent. As indicated hereinbefore, the wetting agent may be the same as, or different from, the wetting agent used for the particulate low density agent. For example, the wetting agent for the low density agent may be mineral oil-based and the wetting agent for the oxidising agent may be fuel oil based. Preferably, however, the wetting agents are the same, if only for manufacturing convenience.

The weight ratio of wetting agent to particulate oxidising agent is preferably from about 4:96 to about 8:92 on a weight basis. Preferably, the ratio is from about 5:95 to 6:94, i.e. close to being oxygen balanced.

The proportions of coated particulate low density agent and coated oxidising agent will be governed by the desired density of the explosive composition and the desired oxygen balance. As will be understood, the proportions will also be governed by whether the composition is to be mixed with another explosive, e.g. a slurry explosive. The weight ratio of coated oxidising agent to uncoated low density agent in the explosive composition of the present invention typically is from about 1:1 to about 10:1.

If mixed with other explosive compounds or compositions, for example with ANFO, slurry explosives and emulsion explosives, the presence of the present explosive composition enables the control of the mixture's density to values ranging between the densities of the two individual products.

Suitable applications for the present composition, either alone or as a part of other ingredients in an explosive composition, include controlled blasting in open pit and quarry operations, coal seam blasting, overburden removal, ornamental rock quarrying, soft ground blasting and other applications requiring control of the energy distribution and output of an explosive.

The present low density composition is made by separately coating particles of the low density agent and particles of the oxidising agent with the appropriate wetting agent, and then mixing the coated low density agent and coated oxidising agent. A preferred composition is made from foamed polystyrene beads which are coated with tackified mineral oil, vegetable oil or lubricating oils, and ammonium nitrate fines which have also been coated with tackified mineral oil.

The coated low density particles may be mixed with the coated oxidising agent by sprinkling the particulate oxidizing agent on the coated low density agent and applying a gentle mixing/stirring action. The oxidizing agent is added in a sufficient amount as to achieve the desired density and obtain a free flowing product.

Particulate explosive compositions and combinations thereof may be mixed with the coated low density agent or the low density agent and oxidising agent composition, in order to increase sensitivity and performance of the composition under adverse field conditions. Such explosives include PETN, RDX, TNT, HMX, nitroguanidine and other known explosive compounds.

The invention is illustrated by reference to the following non-limiting examples,

EXAMPLE 1

Expanded polystyrene beads, having a diameter of between about 0.5 and about 2 mm, were taken and coated with 10 wt. % wetting agent. The wetting agent consisted of 98 wt % mineral oil and 2 wt. % Vanlube TK-100 (trade mark) tackifier additive, which is readily soluble in mineral oil. Separately, ground ammonium nitrate (passing mesh #14) was coated with about 5 wt. % of the same wetting agent. Samples of the coated polystyrene beads and coated ammonium nitrate particles were mixed together in various weight ratios. The resulting compositions had densities as shown in Table I. Some of the compositions were detonated in 3" and 2" nominal diameter schedule 40 steel pipes using a 225 g primer. Each of the primers was initiated with a #6 electric blasting cap. Velocities of detonation are as shown in the tables below. Table I shows the detonation results for the compositions, in 3" schedule 40 pipe; and Table II shows results for the compositions, in 2" schedule 40 pipe. Table III shows results for the compositions, detonated with a #6 electric blasting cap and a Detaprime (trade mark) mini-booster in 3" ABS pipe, to simulate an unconfined shot.

TABLE I

| Density (g/cm$^3$) | Velocity of detonation (m/s) |
|---|---|
| 0.175 | 2075 |
| 0.153 | 2185 |
| 0.123 | 1747 |
| 0.100 | 1931 |
| 0.081 | 1318 |
| 0.066 | 1904 |

TABLE II

| Density (g/cm$^3$) | Velocity of detonation (m/s) |
|---|---|
| 0.187 | 1796 |
| 0.143 | 1889 |
| 0.130 | 1514 |
| 0.122 | 1971 |

TABLE II-continued

| Density (g/cm$^3$) | Velocity of detonation (m/s) |
|---|---|
| 0.083 | 1053 |
| 0.072 | 1851 |

TABLE III

| Density (g/cm$^3$) | Velocity of detonation (m/s) |
|---|---|
| 0.142 | failed with #6 blasting cap |

What is claimed is:

1. A method for making an explosive composition comprising the steps of:

a) coating a particulate synthetic polymeric low density agent with from 5 to 30 wt. %, based on the low density agent weight, of a first wetting agent which comprises a first flowable carbonaceous fuel and a first tackifying agent for said first flowable carbonaceous fuel, to form a coated low density agent;

b) coating a particulate oxidizing agent with a second wetting agent which comprises a second flowable carbonaceous fuel and a second tackifying agent for said second flowable carbonaceous fuel, to form a coated oxidizing agent; and c) mixing the coated low density agent with the coated oxidizing agent.

2. An explosive composition according to claim 1 wherein the weight ratio of coated oxidizing agent to uncoated low density agent is between 1:1 and 10:1.

3. An explosive composition comprising a mixture of:

a) a particulate synthetic polymeric low density agent coated with from 5 to 30 wt. %, based on the low density agent weight, of a first wetting agent which comprises a first flowable carbonaceous fuel and a first tackifying agent for said first flowable carbonaceous fuel; and b) a particulate oxidizing agent, coated with a second wetting agent which comprises a second flowable carbonaceous fuel and a second tackifying agent for said second flowable carbonaceous fuel;

wherein said low density agent is coated with said first wetting agent in one step prior to mixing with said oxidizing agent which has been coated with said second wetting agent in another step.

4. An explosive composition according to claim 3 wherein the second wetting agent is the same as the first wetting agent.

5. An explosive composition according to claim 3 wherein the particulate low density agent is selected from the group consisting of synthetic thermoplastic polymer bubbles and expanded synthetic carbonaceous polymers.

6. An explosive composition according to claim 5 wherein the expanded synthetic carbonaceous polymers are selected from the group consisting of a foamed polystyrene, a foamed polyurethane, a foamed polyolefin and mixtures thereof.

7. An explosive composition according to claim 6 wherein the expanded synthetic carbonaceous polymers have a density of less than about 0.1 g/cm$^3$.

8. An explosive composition according to claim 3 wherein the particulate low density agent is a foamed polystyrene having a density of less than about 0.05 g/cm$^3$.

9. An explosive composition according to claim 3 wherein the first and second flowable carbonaceous fuels are selected from paraffinic oils, vegetable oils, greases, light waxes, saccharose, glucose, fructose, maltose, molasses and mixtures thereof.

10. An explosive composition according to claim 6 wherein the first and second flowable carbonaceous fuels are selected from the group consisting of paraffinic oils, vegetable oils, sugar based fuels and light waxes.

11. An explosive composition according to claim 10 wherein the first and second tackifying agents are ethylene-propylene copolymers.

12. An explosive composition according to claim 10 wherein the first and second flowable carbonaceous fuels are mineral oil.

13. An explosive composition according to claim 3 wherein the first and second tackifying agents are ethylene-propylene copolymers.

14. An explosive composition according to claim 3 wherein the particulate oxidizing agent is selected from alkali metal nitrates, alkaline earth metal nitrates, alkali metal chlorates, alkaline earth metal chlorates, alkali metal perchlorates, alkaline earth metal perchlorates, urea nitrates, guanidine nitrates and mixtures thereof.

15. An explosive composition according to claim 10 wherein the particulate oxidizing agent passes through a 14 U.S. Standard mesh.

16. An explosive composition according to claim 5 wherein the expanded synthetic carbonaceous polymers have a density of less than about 0.1 g/cm$^3$ and are selected from the group consisting of a foamed polystyrene, a foamed polyurethane, a foamed polyolefin and mixtures thereof, the first and second flowable carbonaceous fuels are selected from the group consisting of paraffinic oils, vegetable oils, sugar based fuels and light waxes, and the particulate oxidizing agent is selected from alkali metal nitrates, alkaline earth metal nitrates, alkali metal chlorates, alkaline earth metal chlorates, alkali metal perchlorates, alkaline earth metal perchlorates, urea nitrates, guanidine nitrates and mixtures thereof.

17. An explosive composition according to claim 16 wherein the particulate low density agent is a foamed polystyrene having a density of less than about 0.05 g/cm$^3$.

18. An explosive composition according to claim 16 wherein the first and second flowable carbonaceous fuels are mineral oil.

19. An explosive composition according to claim 16 wherein the first and second tackifying agents are ethylene-propylene copolymers.

20. An explosive composition according to claim 17 wherein the first and second flowable carbonaceous fuels are mineral oil and the first and second tackifying agents are ethylene-propylene copolymers.

21. An explosive composition according to claim 16 which is mixed with a further explosive composition selected from the group consisting of ammonium nitrate and fuel oil mixtures (ANFO), emulsion explosive compositions, slurry explosive compositions, mixtures of ANFO and emulsion explosive compositions, and mixtures of ANFO and slurry explosive compositions.

* * * * *